United States Patent [19]

Mottana et al.

[11] Patent Number: 4,635,526

[45] Date of Patent: Jan. 13, 1987

[54] WEAPON FOR LAUNCHING A NUMBER OF GRENADES

[75] Inventors: Sergio Mottana, Carpenedolo; Mostura Roberto, Brescia, both of Italy

[73] Assignee: Luigi Franchi S.p.A., Brescia, Italy

[21] Appl. No.: 602,759

[22] Filed: Apr. 23, 1984

[30] Foreign Application Priority Data

Oct. 25, 1982 [IT] Italy ..... 23278/82[U]

[51] Int. Cl.[4] ..... F41F 21/00; F41G 1/44; F41G 5/00; F41G 11/00

[52] U.S. Cl. ..... 89/1.41; 89/37.09; 89/40.06; 89/41.16

[58] Field of Search ..... 89/37.05, 41.19, 40.06, 89/41.16, 1.3, 1.41, 37.09, 40.6

[56] References Cited

U.S. PATENT DOCUMENTS

| | | | |
|---|---|---|---|
| 12,522 | 3/1855 | Wolther | 89/41.16 |
| 29,331 | 7/1860 | Thayer | 89/41.16 X |
| 1,311,860 | 7/1919 | Holzworth | 89/1.41 |
| 1,334,983 | 3/1920 | Arter | 89/1.41 |
| 1,448,587 | 3/1923 | Arntzen | 89/41.16 X |
| 1,660,595 | 2/1928 | Butler | 89/1.41 |
| 1,851,148 | 3/1932 | Barnes | 89/37.09 |
| 2,091,278 | 8/1937 | Goebert et al. | 89/37.09 |
| 3,643,545 | 2/1972 | Nahas | 89/1.3 |
| 3,762,269 | 10/1973 | Rusbach | 89/41.16 |
| 3,897,714 | 8/1975 | Perrin et al. | 89/1.41 X |

FOREIGN PATENT DOCUMENTS

| | | | |
|---|---|---|---|
| 321923 | 6/1920 | Fed. Rep. of Germany | 89/40.6 |
| 333669 | 1/1936 | Italy | 89/40.6 |

*Primary Examiner*—David H. Brown

*Attorney, Agent, or Firm*—Birch, Stewart, Kolasch & Birch

[57] ABSTRACT

A weapon for launching a number of grenades, simultaneously or otherwise, includes a plate mounting on which three launching tubes are pivoted in correspondence with their breeches about respective elevating pins. Two of the launching tubes are connected to their elevating pins by ball-joints. The weapon also has a device for elevating the launching tubes and a device for traversing the launching tubes.

6 Claims, 4 Drawing Figures

WEAPON FOR LAUNCHING A NUMBER OF GRENADES

BACKGROUND OF THE INVENTION

1. Field of the Invention

The present invention relates to a weapon for launching a number of grenades, having a mechanism for selecting the launching frequency, that is, a device which allows the weapon to be used for launching singly or in a salvo.

More particularly, the weapon according to the invention is useful for launching, simultaneously or otherwise, a number of grenades of the so-called anti-personnel and/or anti-personnel/anti-vehicle type.

2. Description of Background Art

Grenades of the type mentioned above have until now been launched from guns appropriately provided with a particularly well-known accessory termed a grenade-launcher.

The advantages of launching grenades from a gun are well known to experts in the art, who are even more aware of the disadvantages and limitations of use which in many cases impose a choice of tactics of arguable effectiveness that cannot be carried out quickly, and which, particularly, are onerous at least from the point of view of the number of personnel that must be used.

SUMMARY AND OBJECTS OF THE INVENTION

The main object of this invention is to provide a weapon for launching a number of grenades, which has structural and functional characteristics such as to allow a substantial increase in the launching rate compared to that possible until now for the same number of personnel, without however increasing the dispersion of the rounds, and thereby clearly improving the effectiveness of munitions such as anti-personnel and/or anti-personnel/anti-vehicle grenades.

This object, and others which will become more apparent from the description which follows, are achieved by a grenade-launching weapon of the type specified above which, according to the present invention, is characterised in that it includes:

a plate mounting;

at least two launching tubes, each of which includes a barrel and a breech, the launching tubes being pivoted about respective elevation pins supported by the mounting and at least one of the launching tubes being connected by a joint to its elevation pin;

a device for elevating the launching tubes, and a device for traversing the launching tubes.

To advantage, and in accordance with a preferred embodiment, the weapon according to the invention includes three launching tubes of which the central tube is articulated to its elevation pin by an elevation device and the lateral tubes are connected by ball joints to respective elevation pins supported by the mounting and are rigid for elevation with the central tube, the traversing device acting only on the lateral launching tubes.

BRIEF DESCRIPTION OF THE DRAWINGS

Further characteristics and advantages will become more apparent from the description of one embodiment of the invention given, purely by way of non-limiting example, with reference to the appended drawings, in which.

DETAILED DESCRIPTION OF THE PREFERRED EMBODIMENT

Figure 1:
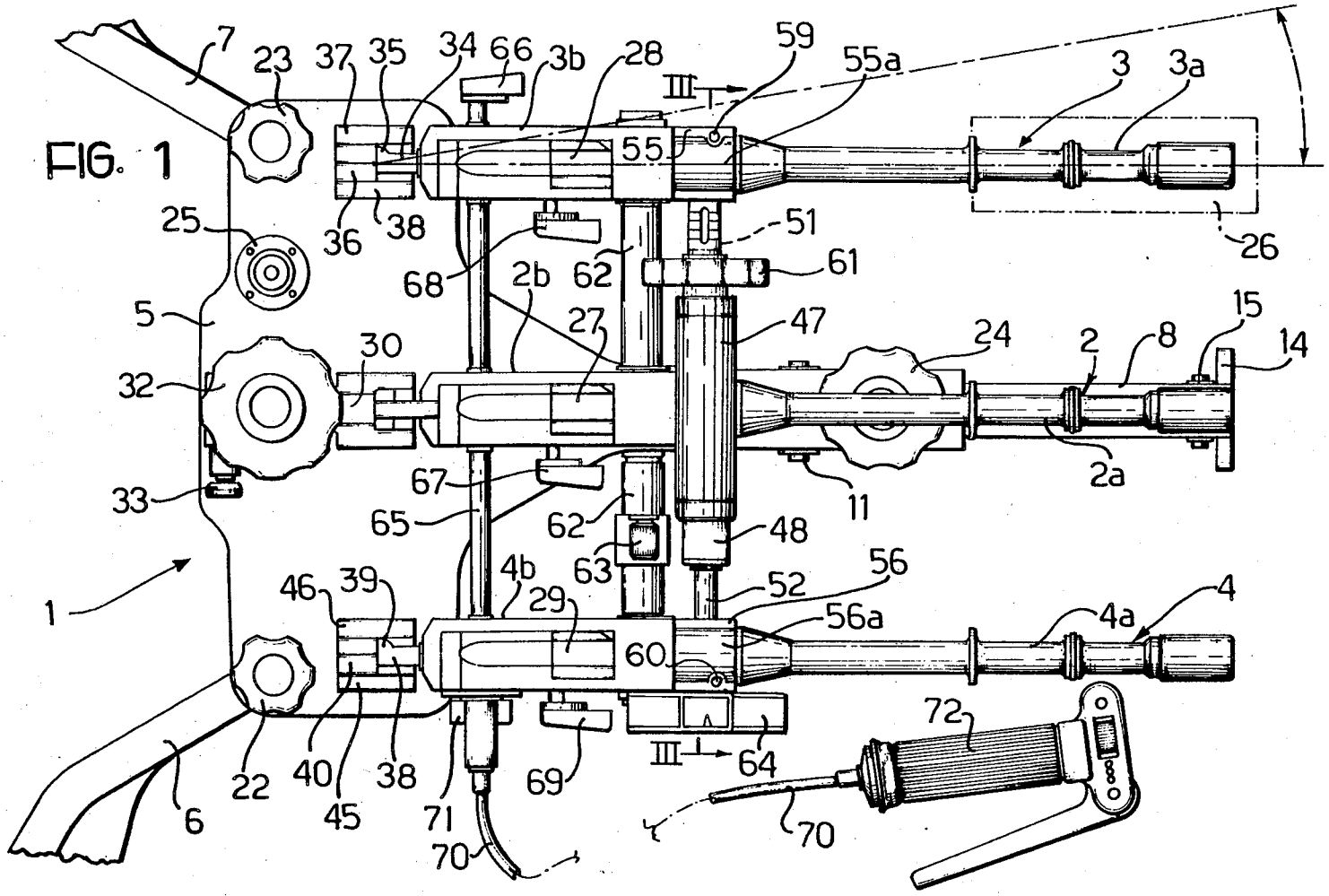
FIG. 1 is a plan view of a weapon for launching grenades simultaneously or otherwise, according to the present invention.
Figure 2:
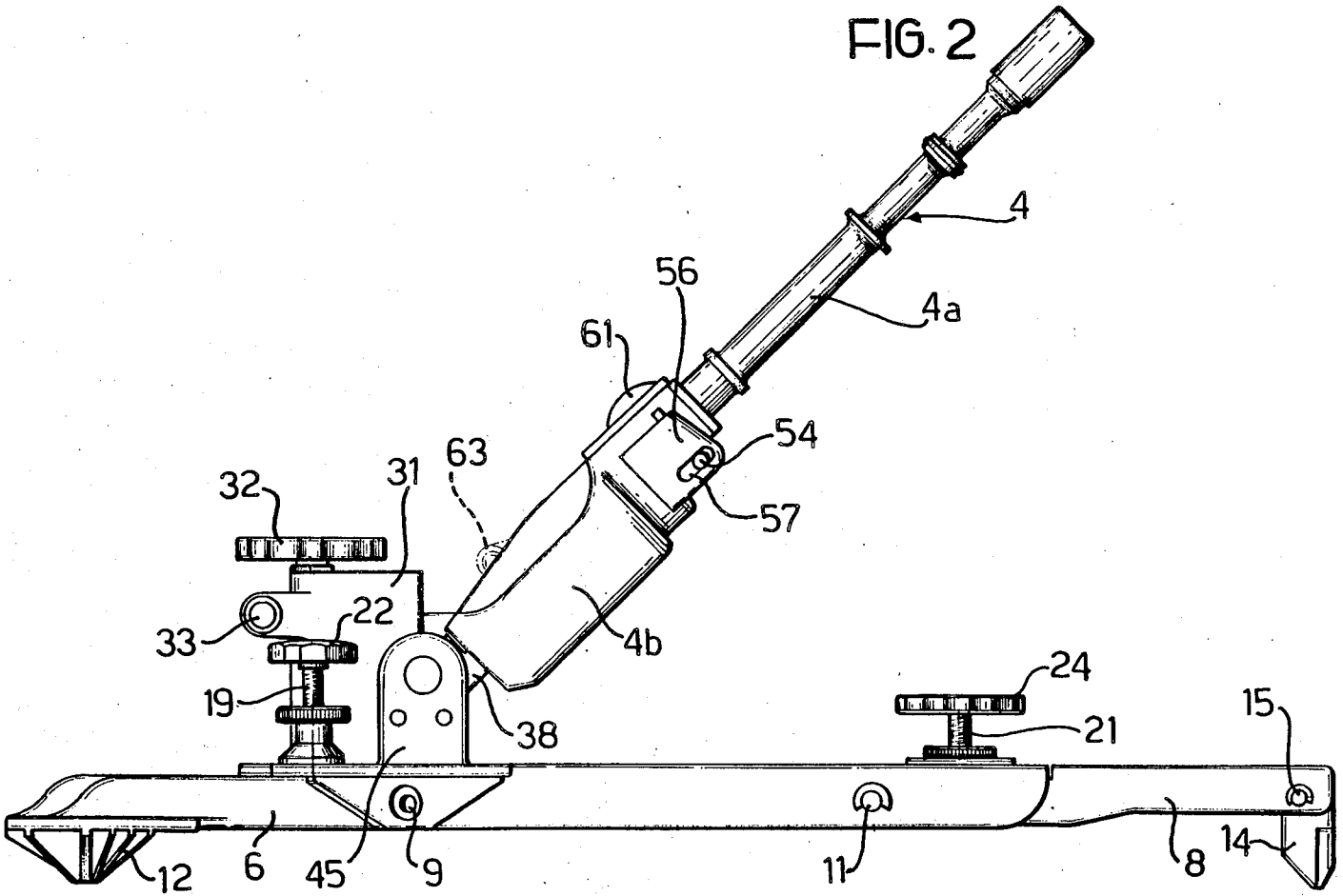
FIG. 2 is a side view of the weapon of FIG. 1.
Figure 3:
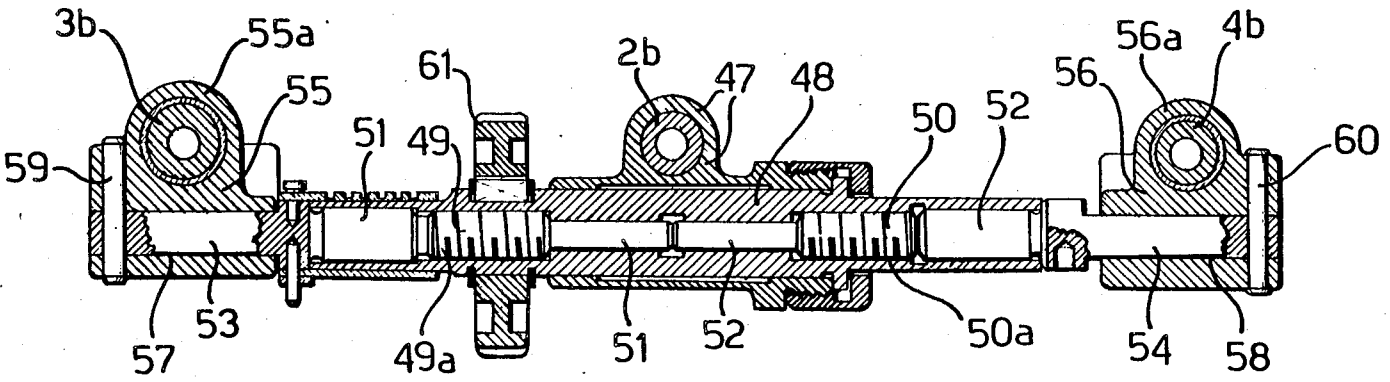
FIG. 3 is a section taken on an enlarged scale on the line III—III of FIG. 1.
Figure 4:
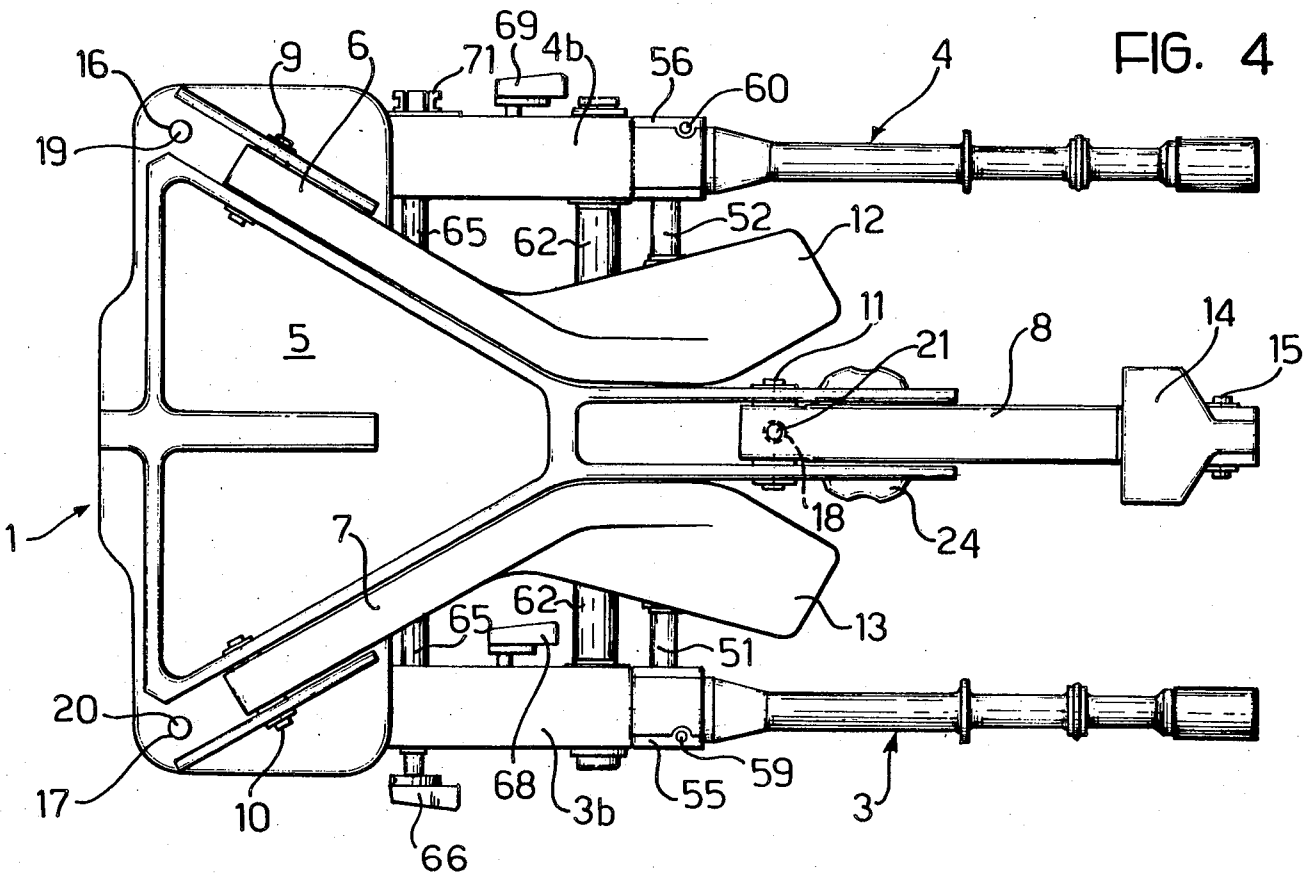
FIG. 4 shows the weapon of FIG. 1 from the below in a non-operational condition.

With reference to the drawings, a grenade-launching weapon according to the invention includes a mounting 1 and three launching tubes 2, 3 and 4.

The mounting 1 is constituted by a base plate 5, preferably of pressed light alloy, having three folding legs, two rear legs 6, 7 and a front leg 8, each of which is rotatably mounted about a respective pin 9, 10, 11 on the base plate 5.

Each of the legs has a respective foot 12, 13, 14 for resting on the ground. In accordance with a preferred but non-limiting embodiment, while the feet 12, 13 of the rear legs 6, 7 are fixed, that is, are formed integrally with their respective legs, the foot 14 of the front leg 8 is in its turn rotatably mounted on a pin 15 and is, to advantage, beak-shaped.

Close to the pins 9, 10 and 11, the plate 5 has respective threaded holes 16, 17 and 18 in which corresponding threaded shafts 19, 20 and 21 are screwed, the shafts having operating knobs 22, 23 and 24. The threaded shafts 19, 20 and 21 constitute essentially reaction screws for the respective legs 6, 7 and 8 when they are in their "withdrawn" position relative to the plate 5; the plate 5 may be positioned accurately horizontal by means of these reaction screws and a spirit level 25. To advantage, the spirit level 25 is attached by conventional means to the plate itself for which it is a basic accessory.

The launching tubes 2, 3 and 4 are identical and each of them comprises a barrel (*2a*, *3a*, *4a*) for receiving in a conventional manner a grenade-launcher, generally indicated 26, and a breech (*2b*, *3b*, *4b*) to which the barrel is connected in a conventional manner.

Each breech (*2b*, *3b*, *4b*) defines a firing chamber (not shown) closed by a respective breech-block 27, 28, 29, preferably of the flip-over type. Furthermore, each breech (*2b*, *3b*, *4b*) houses conventional firing and extraction mechanisms (not shown) with their safety devices (also conventional and hence not shown). The breech *2b* of the central launching tube 2 is mounted at its rear end on a pin 30 of a conventional elevating device, the body of which is schematically indicated 31. A control knob of this device for adjusting the elevation is indicated 32, while a device for disengaging this control to allow rapid elevation is indicated 33.

Consequently, the angular displacement of the launching tube 2 about the pin 30 occurs only in the vertical plane when the weapon is located on the ground and is ready for firing.

The breech *3b* is provided at its rear end with an axially extending projection 34 terminating with a spherical head or protuberance 35 engaged in the manner of a ball-joint in a corresponding seat (not shown) formed in a body 36 pivoted in its turn (about a pivot axis parallel to the pin 30 mentioned above) on a pair of supports 37, 38 of the base plate 5.

The breech 4*b* is also connected at its rear end by a ball-joint 38', 39 to a body 40 provided on two supports 45, 46 of the plate 5 about a pivot axis parallel to the pin 30 for elevating the launching tube 2.

A tubular body 47 rotatably housing a coaxial sleeve 48 is fixed transversely to the front end of the breech 2*b*. The sleeve 48 has two internally threaded portions 49*a*, 50*a* with opposite threads which are engaged with respective portions 49, 50 of two shafts 51, 52. The shafts 51, 52 have respective end portions 53, 54 outside the sleeve 48 fixed to the breeches 3*b* and 4*b*, respectively, in the manner which will be described below.

To the breeches 3*b* and 4*b* are fixed coaxially, by conventional means not shown, the sleeve portions 55*a*, 56*a* of two bodies 55, 56 provided respectively, in positions beneath the breeches, with holes 57, 58 which open towards the central breech 2*b* and have axes perpendicular to the axes of the respective barrels 3*a*, 4*a*.

The bodies 55, 56 are also provided with respective pins 59, 60 the axes of which, together with the axes of the barrels 3*b*, 4*b* and the holes 57, 58, constitute respective cartesian reference frames. The ends of terminal portions 53, 54 of the shafts 51, 52 are pivoted on the portions of the pins 59, 60 which pass through the holes 57, 58. It should be noted that the holes 57, 58 are of the slot type, so as to allow the shafts 51, 52 to move angularly about their respective pins 59, 60.

A knob 61 is mounted coaxially on and is rigid for rotation with the sleeve 48. The knob may be operated to withdraw the threaded portions 49 and 50, and hence the shafts 51 and 52, simultaneously from the sleeve 48 or to screw them simultaneously into it. Consequently, the launching tubes 3, 4 are simultaneously traversed to diverge or converge relative to the central launching tube 2, while they are rigid with the launching tube 2 when the latter undergoes angular elevating movements about the pin 30.

The knob 61 is, therefore a knob for simultaneously adjusting the traverse of the launching tubes 3, 4 relative to the tube 2.

From the above, it can be seen that the weapon of this invention has one elevating system for all three launching tubes which is constituted by any mechanism known in the field, particularly screw mechanisms which allow the possibility of rapid adjustments for establishing a preliminary elevation and subsequent operation, for example by a wheel 32, for setting the precise elevation. Clearly other conventional elevating devices, such as friction or screw-nut types, may be used.

The weapon of this invention also has a control 62 for simultaneously opening the aforesaid breech-blockes 27, 28 and 29, a control which is operated by means of a hand lever 63.

A conventional display device for the angle of elevation, schematically indicated 64, is preferably fixed by conventional means (not shown) to the outer side of the breech 4*b* of the launching tube 4.

The weapon of this invention is also provided with a control 65 for simultaneous launching from the three launching tubes, a control which is operated by a handgrip 66. Naturally, each launching tube has a respective trigger 67, 68, 69 for single launches.

The control 65 may be connected by an artillery cable 70 and quick-coupling of conventional type to a manual remote control 72 for both single and salvo launches from the weapon of the invention.

The loading of the launching tubes 2, 3 and 4 is carried out by opening the breech-blocks 27, 28 and 29, inserting cartridges (which may be of the ordinary military ball or launching type) manually into the respective firing chambers, and then closing the breech-blocks. When all three breech-blocks are closed, the operator may select the launching of the grenade mounted on the central launching tube 2 or the simultaneous launching of the three grenades by means of the lever 66.

It should be noted that the weapon described above with reference to the appended drawings is a ground firing version of the weapon.

Furthermore, while the description refers to the launching of grenades of the so-called anti-personnel and/or anti-personnel/anti-vehicle type, it is clear that the weapon of the invention may also be used, to advantage, for launching smoke grenades, illuminating projectiles and the like.

What is claimed is:

1. A weapon for launching a number of grenades simultaneously or otherwise comprising
   - a plate,
   - three launching tubes, each one of said tubes including a barrel and a breech,
   - said launching tubes are made up of a central launching tube and a lateral launching tube on either side of said central launching tube,
   - means for pivotally connecting each said breech to said plate,
   - means for elevating said launching tubes, and
   - means for traversing said launching tubes including means for traversing said lateral launching tubes simultaneously with a single action,
   - said traversing means including a telescopic beam member fixed transversely to said breech of said central launching tube and connecting said launching tubes to each other.

2. A weapon as defined in claim 1, wherein said plate has three folding legs for resting on the ground, respective reaction screw devices for said legs, and a levelling device for the horizontal positioning of said plate itself.

3. A weapon as defined in claim 1, wherein said central launching tube is pivoted by its said breech to said elevating means and said lateral launching tubes are connected by respective ball-joints at their said breeches to said plate whereby said lateral tubes are rigid for elevation with said central tube and said traversing device acts only on said lateral tubes.

4. A weapon as defined in claim 3, wherein said plate has three folding legs for resting on the ground, respective reaction screw devices for said legs, and a levelling device for the horizontal positioning of said plate itself.

5. A weapon as defined in claim 3, wherein said telescopic beam member comprises:
   - a tubular body fixed transversely to the breech of said central launching tube;
   - a sleeve mounted rotatably and coaxially in said tubular body and having two oppositely threaded portions, and
   - two threaded shafts in engagement with respective said threaded portions and having respective ends fixed to said lateral launching tubes.

6. A weapon as defined in claim 5, wherein said plate has three folding legs for resting on the ground, respective reaction screw devices for said legs, and a levelling device for the horizontal positioning of said plate itself.

* * * * *